US006896604B1

(12) United States Patent
Taylor et al.

(10) Patent No.: US 6,896,604 B1
(45) Date of Patent: May 24, 2005

(54) HANDHELD FLUSH-CUTTING CONCRETE SAW HAVING A DUST ABATEMENT VACUUM HOOD

(75) Inventors: Jared J. Taylor, Orem, UT (US); Matthew B. Haney, Provo, UT (US)

(73) Assignee: Precision Concrete Cutting, Inc., Provo, UT (US)

( * ) Notice: Subject to any disclaimer, the term of this patent is extended or adjusted under 35 U.S.C. 154(b) by 0 days.

(21) Appl. No.: 10/833,690

(22) Filed: Apr. 27, 2004

(51) Int. Cl.[7] ..... B24B 55/04

(52) U.S. Cl. ..... 451/451; 451/456; 451/453; 451/442

(58) Field of Search ..... 451/451, 452–457, 451/360, 388

(56) References Cited

U.S. PATENT DOCUMENTS 5,411,433 A * 5/1995 Keller ..... 451/451
6,027,399 A * 2/2000 Stewart ..... 451/353
6,595,196 B2 * 7/2003 Bath ..... 125/13.01
2003/0224707 A1 * 12/2003 Segiel, Jr. ..... 451/451

* cited by examiner

*Primary Examiner*—Lee D. Wilson
(74) *Attorney, Agent, or Firm*—Angus C. Fox, III

(57) ABSTRACT

A dust abatement vacuum hood, provided for a flush-cutting concrete saw, includes a rigid shell that is preferably either vacuum formed or injection molded from a tough polymeric material that may be reinforced with structural fibers. Alternatively, the vacuum hood may be stamped or cast from a durable metal. The vacuum hood is equipped with a vacuum port to which one end of a vacuum hose may be attached. The opposite end of the vacuum hose is attached to a vacuum cleaner system. The vacuum hood has a spring-mounted attachment bracket that can be bolted directly to the concrete saw. As the blade of the concrete saw rotates, pulverized concrete is discharged into a chamber opening of the vacuum hood. Internally, the vacuum hood is shaped so that the pulverized concrete is directed toward the vacuum port, from where it is directed to the vacuum cleaner system.

34 Claims, 16 Drawing Sheets

HANDHELD FLUSH-CUTTING CONCRETE SAW HAVING A DUST ABATEMENT VACUUM HOOD

RELATED APPLICATIONS

This application is related to U.S. patent application Ser. No. 10/155,663, filed by M. Ballard Gardner on May 24, 2002, and titled Method and Apparatus for Removing Trip Hazards in Concrete Sidewalks.

BACKGROUND OF THE INVENTION

1. Field of the Invention

This invention relates to methods and apparatus for removing trip hazards in concrete sidewalks and, more particularly, to handheld, flush-cutting concrete saws and dust abatement devices therefor.

2. Description of the Prior Art

Signed into law as Section 12181 of Title 42 of the United States Code on Jul. 26, 1990, the Americans with Disabilities Act (ADA) is a wide-ranging legislation intended to make American society more accessible to people with disabilities. The legislation, which took effect on Jul. 26, 1992, mandates, among other things, standards for access to public facilities, including public sidewalks. The law not only requires that curb cuts be made at intersections and crosswalks to facilitate wheelchair access, but also mandates specifications for slopes and transitions between two surfaces of different levels. Some of the relevant provisions of the law are as follows:

4.5.2 Changes in Level. Changes in level up to ¼ inch (6 mm) may be vertical and without edge treatment. Changes in level between ¼ inch and ½ inch (6 mm and 13 mm) shall be beveled with a slope no greater than 1:2. Changes in level greater than ½ inch (13 mm) shall be accomplished by means of a ramp that complies with 4.7 or 4.8.

4.72 Slope. Slopes of curb ramps shall comply with 4.8.2. Transitions from ramps to walks, gutters, or streets shall be flush and free of abrupt changes. Maximum slopes of adjoining gutters, road surface immediately adjacent to the curb ramp, or accessible route shall not exceed 1:20.

4.8.2 Slope and Rise. The least possible slope shall be used for any ramp. The maximum slope of a ramp in new construction shall be 1:12. The maximum rise for any run shall be 30 inches (760 mm). Curb ramps and ramps to be constructed on existing sites or in existing building or facilities may have slopes and rises as allowed in 4.1.6(3)(a) if space limitations prohibit the use of a 1:12 slope or less.

3-a-1. A slope between 1:10 and 1:12 is allowed for a maximum rise of 6 inches.

3-a-1. A slope between 1:8 and 1:10 is allowed for a maximum rise of 3 inches. A slope steeper than 1:8 is not allowed.

Public sidewalks and private sidewalks open to the public must comply with the foregoing provisions of the ADA. Tree roots are the single most significant cause of unlevel conditions of sidewalks. Because sidewalks are generally made of contiguous concrete slabs, unevenness typically occurs at the joints between the slabs. Unstable and inadequately compacted soils can also lead to differential settling of adjacent slabs.

Historically, trip hazards caused by uneven lifting and settling of contiguous sidewalk sections have been eliminated either by tearing out the old concrete and replacing it with new slabs having no abrupt transitions between joints, by forming a transition ramp on the lowermost section with macadam, or by creating a chamfer on the edge of the uppermost section. The first method represents the most expensive fix. The second method, which uses dark-colored macadam on a light-colored sidewalk, is unsightly. If the chamfer is made using a surface cutter or grinder, the second method is slow, given that all material removed through grinding must be pulverized. In addition, if the process is performed with a drum cutter, the equipment is relatively expensive and leaves a rough surface. In addition, most equipment used heretofore is incapable of removing the trip hazard over the entire width of a sidewalk. Furthermore, if two adjacent sidewalk slabs have twisted in opposite directions as they have settled or raised, it may be necessary to create a ramp across a portion of the width of the sidewalk on both sides of the joint.

A method and apparatus for removing a trip hazards from concrete sidewalks have been developed by M. Ballard Gardner, and are disclosed in U.S. Pat. application Ser. No. 10/155,663, which is identified above. Using the method and apparatus, a trip hazard may be removed over the entire width of a sidewalk, and portions of two concrete slabs intersecting at a common joint may be chamfered, without necessitating the pulverization all material removed during the chamfer operation. A right-angle grinder motor, in combination with a specially-designed hub and a circular diamond-grit-edged blade, is employed to chamfer the trip hazard in a flush-cutting operation.

Referring now to FIG. 1, a typical right-angle grinder motor 100 is shown. The grinder motor 100 has a body 101, which encloses an electric drive motor having a generally horizontal output shaft and a cooling fan (neither of which are visible in this view). A right-angle gear train assembly 102 is attached to the front of the body 101. The right-angle gear train assembly 102 is coupled to the horizontal output shaft, and has a generally vertical, rotatably-powered, threaded output spindle 103. The grinder motor 100 also has a handle 104, a power switch 105, motor brush caps 106, cooling vents 107, and an electrical power cord 108. Although the method and apparatus for removing trip hazards is described in connection with an electrically-powered right-angle grinder motor, a compressed-air-powered right-angle grinder motor may be employed with equally satisfactory results.

Referring now to FIGS. 2 through 6, a unique hub 200 is designed for installation on the threaded output spindle 103 of an angle grinder, such as the electric grinder motor 100 shown in FIG. 1. The hub 200 has an attachment collar 201 that is unitary and concentric with both a blade mounting flange 202 and a blade centering shoulder 203 on the flange 202. A central mounting aperture 204 passes through the collar 201, the flange 202, and the shoulder 203. The mounting aperture 204 is threaded to receive and engage the threaded output spindle 103 of the right-angle grinder motor 100. The attachment collar 201 has at least one pair of flattened parallel sides 205 for receiving a wrench used to tighten the hub 200 on the output spindle 103. The side 206 of the blade mounting flange 202 opposite the collar 201 is equipped with at least two, and preferably three to six, countersunk holes 207, by means of which a generally circular, diamond-grit-edged rotary blade may be attached with countersinking screws and self-locking nuts (not shown in this drawing figure).

Referring now to FIG. 7, a rotary blade 700 is equipped with a central positioning aperture 701 sized to fit over the blade centering shoulder 203 with a generally minimum amount of clearance required for a non-interference fit. The blade is equipped with non-threaded countersunk holes 702 which align with the threaded countersunk holes 202 on the blade mounting flange 202. Countersinking screws (shown in FIG. 8) are employed to affix the blade 700 to the blade mounting flange 202. When fully tightened in the countersunk threaded holes 202 in the flange 202, the heads of each of the screws is flush with the surface of the blade 700. Although it is possible to countersink only the holes 702 of the saw blade 700 and use specially designed screws having a very shallow countersinking head, conventional countersinking screws have greater structural integrity. The edge 703 of blade 700 is formed from a metal matrix which incorporates diamond grit throughout, which enables the blade, when rotating, to cut through "green" or seasoned concrete. For a presently preferred embodiment of the blade, the new diameter is 8 inches (about 203 mm), and the blade core has a thickness of about 0.55 inch. The height of the blade centering shoulder 203 is preferably also about 0.055 inch. If the blade centering shoulder were to protrude through the blade, the edges thereof would become peened over the edges of the blade centering aperture 701, thereby making removal of the blade difficult.

Referring now to the exploded assembly 800 of FIG. 8, an electrically-powered right-angle grinder motor 100 is shown together with the hub 200, the blade 700, multiple countersinking blade-attachment screws 801 and multiple self-locking nuts 802, all positioned for assembly as a unit. It will be noted that each of the self-locking nuts has a deformable polymeric insert 1005, which provides the self-locking function.

Referring now to the assembled concrete saw 900 of FIG. 9, the hub 200 has been installed on the output spindle 103 of the right-angled grinder motor 100, and the blade 700 has been secured to the hub 200 with the countersinking screws 801 and the self-locking nuts 802. It will be noted that the lower surface 901 of the blade 700 is completely flat, with no attachment hardware protruding below its surface. By definition, the lower surface 901 of the blade 700 is "flush-mounted" on the hub 200.

Referring now to FIG. 10, the portion of FIG. 9 within the ellipse 10 is shown in cross-sectional format. In this detailed view, it is clearly seen that the attachment collar 201 is unitary and concentric with the blade mounting flange 202 and the blade centering shoulder 203 on the flange 202. The threads 1001 within the central mounting aperture 204, which have spirally engaged the threads 1002 on the output spindle 103, are clearly visible in this view. It will be noted that the head 1003 of each countersinking blade attachment screw 801 has a socket 1004. The blade attachment screws 801 are inserted through the countersunk holes 702 in the blade 700, through the holes 207 in the blade mounting flange 202 and secured with the self-locking nuts 802. Using an allen-type wrench which engages the sockets 1004, the screws 801 may be kept from rotating while the self-locking nuts 802 are tightened against the upper surface of the blade mounting flange 202, thereby securing the blade 700 to the hub 200. It will also be noted that the central positioning aperture 701 in the blade 700 is sized to fit over the blade centering shoulder 203 with a generally minimum amount of clearance required for a non-interference fit.

Referring now to FIG. 11, it will be noted that, at the junction of a first concrete slab 1101 and a second concrete slab 1102, there is a trip hazard 1103 that has been caused by the first slab 1101 being raised with respect to the second slab 1102. Removal of the trip hazard, by making a dry chamfer cut on the first concrete slab 1101, will now be described in detail with reference to the remaining drawing figures. The chamfer, when complete, will have a 1:8 rise. Both slabs 1101 and 1102 rest on a substrate 1104 of gravel, sand or soil. Using the concrete saw (i.e., the right-angle grinder motor 100 with the hub 200 and blade 700 mounted thereon), a first chamfer cut 1105 is made on the edge of concrete slab 1101, which has raised with respect to the second concrete slab 1102. It should be understood that cuts with the concrete saw 900 are made from right to left, as the operator kneels on the high side of the sidewalk. It will be noted that the bottom surface of the blade 901 is in close proximity to the lower cut surface 1106. However, as heads 1003 of the blade-attachment screws 801 are flush with the lower surface of the blade 700, they are shielded from abrasive action of the concrete within the cut 1105. In order to protect the hub 200 from abrasion by the concrete, the cut must stop before the rotating hub 200 contacts the upper edge 1107 of the cut concrete. Using a blade having a diameter of about 8 inches (about 203 mm), a 2.375 inch deep cut may be made without endangering the hub.

Referring now to FIG. 12, the blade has been removed from the cut 1105. It will be noted that a first cantilevered ledge 1201 extends over the cut 1105.

Referring now to FIG. 13, the cantilevered ledge 1201 has been fractured by hitting it with a hammer or other similar instrument.

Referring now to FIG. 14, a second chamfer cut 1401 is made, which is a continuation of the first chamfer cut 1105. Once again, in order to protect the hub 200 from abrasion by the concrete, the cut must stop before the rotating hub 200 contacts the upper edge 1402 of the cut concrete.

Referring now to FIG. 15, the blade has been removed from the cut 1401. It will be noted that a second cantilevered ledge 1501 extends over the cut 1401.

Referring now to FIG. 16, the second cantilevered ledge 1501 has been fractured by hitting it with a hammer or other similar instrument.

Referring now to FIG. 17, a third chamber cut has been made which removes the remainder 1701 of the trip hazard 1103.

Referring now to FIG. 18, the first concrete slab 1101 is shown with the a completed chamfer cut 1801. The cutting equipment, which consists of the right-angle grinder motor 100, the attached hub 200 and blade 700, have been removed, as have been the trip hazard debris pieces 1201, 1401 and 1701.

With training, a skilled worker can make an angled chamfer cut into the edge of a raised concrete slab, so that a smooth transition between a lower slab and the raised slab may be formed. Trip hazards of slightly more than 2.54 cm height can be removed in using three cuts with an eight-inch blade. Trip hazards of nearly two inches in height can be removed with additional cuts, using the invention as heretofore described.

As the trip hazard removal method involves cutting the concrete with a rotating diamond-edged circular saw blade, a considerable amount of dust is created. Because concrete is a mixture of hydrated (i.e., crystalized) cement, aggregate (gravel) and silica sand, the dust contains both cement dust and silica dust. As statistical evidence has shown that the breathing of silica dust can cause lung cancer, it is essential that the saw operator and those in the vicinity of the work be protected from the dust. Although it is fairly simple to provide the saw operator with eye protection and a dust mask, it is more difficult to ensure that all who are near the work area receive protection. Furthermore, as masks are typically not 100 percent effective, dust abatement is a better solution.

SUMMARY OF THE INVENTION

A dust abatement vacuum hood is provided for the flush-cutting concrete saw heretofore described. The vacuum hood includes a rigid shell that is preferably either vacuum formed or injection molded from a tough polymeric material such as acrylonitrile butadiene styrene (ABS) copolymer, polycarbonate, polystyrene, polyvinyl chloride (PVC), polyethylene, polyester, epoxy, or a multi-polymer alloy. For added strength and rigidity, the polymer material may incorporate structural fibers such as glass, graphite or Kevlar®. As an alternative to injection molding and vacuum forming, an open-mold layup process may be used—particularly when epoxy and polyester resins are used in combination with fiber structural fibers. Fiberglass car body components have been produced in this manner for more than half a century. As an alternative to the use of polymeric materials, the vacuum hood may be stamped or cast from a durable metal. Sheet metal stampings may be made, for example, from stainless steel, mild steel, chrome-molybdenum and chrome-manganese steel alloys, aluminum, and titanium. Castings may be made, for example, from metals such as aluminum, magnesium and titanium. The vacuum hood is equipped with a vacuum port to which one end of a vacuum hose may be attached. The opposite end of the vacuum hose is attached to a vacuum cleaner system.

The vacuum hood has a metal, spring-mounted attachment bracket that can be bolted directly to the concrete saw. As the blade of the concrete saw rotates clockwise (viewed from the top of the saw), pulverized concrete is discharged primarily to the right, into a chamber opening the left side of the vacuum hood. Internally, the vacuum hood is shaped so that the pulverized concrete is directed toward the vacuum port, which maintains a lower-than-ambient pressure condition within the vacuum hood. The shape of the vacuum hood and the low-pressure condition within ensures that more than about 95 percent of all concrete dust generated from concrete cutting operations is removed from the atmosphere and deposited in a vacuum system canister.

For a preferred embodiment of the invention, the rigid shell has a ceiling portion and curved wall portions which are unitary and form a chamber. The bottom edges of the rigid shell are wrapped with a resilient polymeric foam layer, which is then covered with a flexible, preferably rubber, rectangular strip that is bent so that it assumes a U-shaped cross section. One upright portion of the "U" is bonded to the inside surface of the rigid shell, while the opposite upright portion is bonded to the outside surface thereof. Pop rivets may be used to secure both upright portions of the "U" to the rigid shell. The padded edges so formed generally lie in a common plane, so that when the vacuum hood is placed on a planar surface, such as a concrete slab, with the padded edges in contact therewith, the chamber is sealed along the padded edges, with the chamber opening providing entry of pulverized concrete in to the chamber. The pulverized concrete is expelled through the vacuum port. The chamber wall portions are shaped so that incoming pulverized concrete is focused toward the vacuum port.

For a preferred embodiment of the invention, the metal attachment bracket is resiliently mounted to the rigid shell via a pair of coil springs, each of which is secured to the rigid shell by an axial bolt and two hex nuts. Four flat fender washers are used in combination with each bolt. Also for the preferred embodiment of the vacuum hood, the ceiling portion of the rigid shell is molded so that it includes a pair of channels, which assist in directing airflow within the chamber to the vacuum port. Also for the presently preferred embodiment of the invention, the diameter of the concrete saw blade is about the same as the width of the chamber opening. When the concrete saw and attached vacuum hood are suspended in the air, the padded edges are positioned below the level of the blade. However, when the concrete saw is making a cut in concrete slab, the padded edges are held against the slab by tension applied by the coil springs.

The vacuum port can be attached with a vacuum hose to a conventional wet/dry vacuum cleaner system. In order to prevent rapid clogging of the internal filter of the vacuum cleaner system, a reuseable cloth filter bag is used within the vacuum cleaner system tank, being coupled directly to the inlet pipe.

BRIEF DESCRIPTION OF THE DRAWINGS

Drawing FIGS. 19 to 29 show a dust abatement vacuum attachment either alone, in combination with the flush-cutting concrete saw, or in combination with both the flush-cutting concrete saw and a vacuum system.

FIG. 1 is a side elevational view of a typical electric right-angle grinder;

FIG. 2 is a top plan view of a first embodiment hub;

FIG. 3 is side elevational view of the first embodiment hub, taken parallel to the wrench flats;

FIG. 4 is side-elevational see-through view of the first embodiment hub, taken perpendicular to the wrench flats;

FIG. 5 is an isometric top view of the first embodiment hub;

FIG. 6 is an isometric bottom view of the first embodiment hub;

FIG. 7 is a top plan view of the blade;

FIG. 8 is an exploded side elevational view of the right-angled grinder of FIG. 1, the hub of FIGS. 2–6, the blade of FIG. 7, and multiple countersinking screws, positioned for assembly;

FIG. 9 is a side elevational view of the right-angled grinder of FIG. 1, having installed thereon the hub of FIGS. 2–6 and the blade of FIG. 7;

FIG. 10 is an enlarged cross-sectional view of the portion of FIG. 9 within the ellipse 10, taken through the central axis and a pair of blade-securing holes;

FIG. 15 is a side elevational view of the concrete slab, with the cutting equipment removed following the second cutting pass;

FIG. 16 is a side elevational view of the cut concrete slab of FIG. 15, following the fracturing of the second overhanging ledge;

FIG. 17 is a side elevational view of the mounted blade making a third chamfer cut on the edge of the raised concrete slab shown in FIG. 11;

FIG. 18 is the concrete slab shown in FIG. 11 following completion of the chamfer cut, and removal of the cutting equipment and debris;

FIG. 19 is a top plan view of a flush-cutting concrete saw and a dust abatement vacuum attachment prior to interconnection;

FIG. 20 is a top plan view of the interconnected flush-cutting concrete saw and dust abatement vacuum attachment of FIG. 19;

FIG. 21 is a bottom plan view of the interconnected flush-cutting concrete saw and dust abatement vacuum attachment of FIG. 19;

FIG. 22 is a left-side elevational view of the dust abatement vacuum attachment of FIG. 19;

FIG. 23 is a bottom plan view of the dust abatement vacuum attachment of FIG. 19;

FIG. 24 is a left-side elevational view of the interconnected flush-cutting concrete saw and dust abatement vacuum attachment of FIG. 19;

FIG. 25 is a right-side elevational view of the interconnected flush-cutting concrete saw and dust abatement vacuum attachment of FIG. 19; and FIG. 26 is top plan view of the dust abatement vacuum attachment interconnected with a vacuum system.

PREFERRED EMBODIMENT OF THE INVENTION

The structure and use of a new dust abatement vacuum hood will now be described with reference to drawing FIGS. 19 to 26. It should be understood that the drawings are meant to be merely illustrative of the presently preferred embodiment of the invention, and that they are not necessarily drawn to scale.

Figures 1, 2, 3, 4, 5, 6:
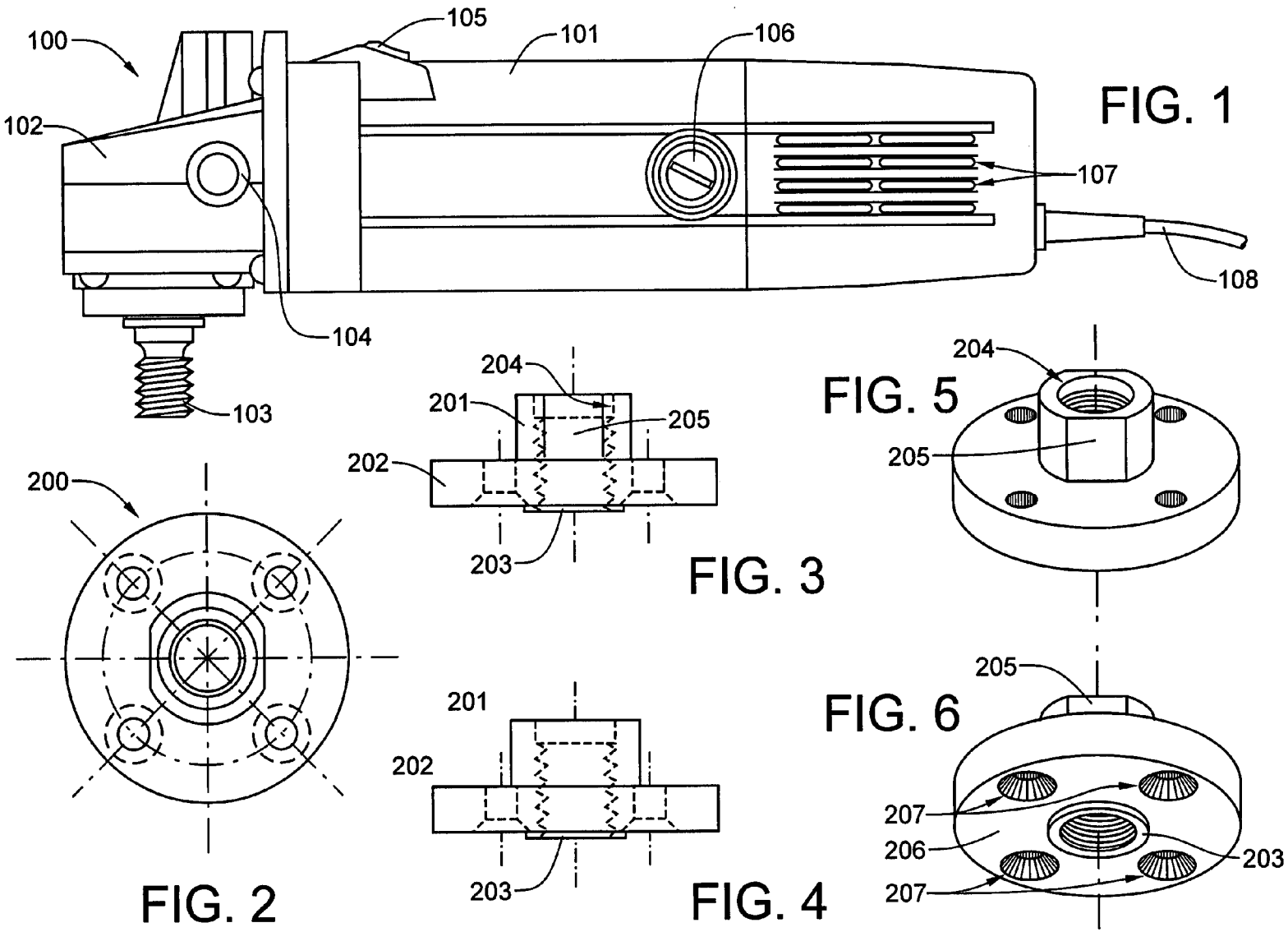
FIGS. 1 to 10 show a preferred embodiment of a flush-cutting concrete saw; drawing
Figure 7:
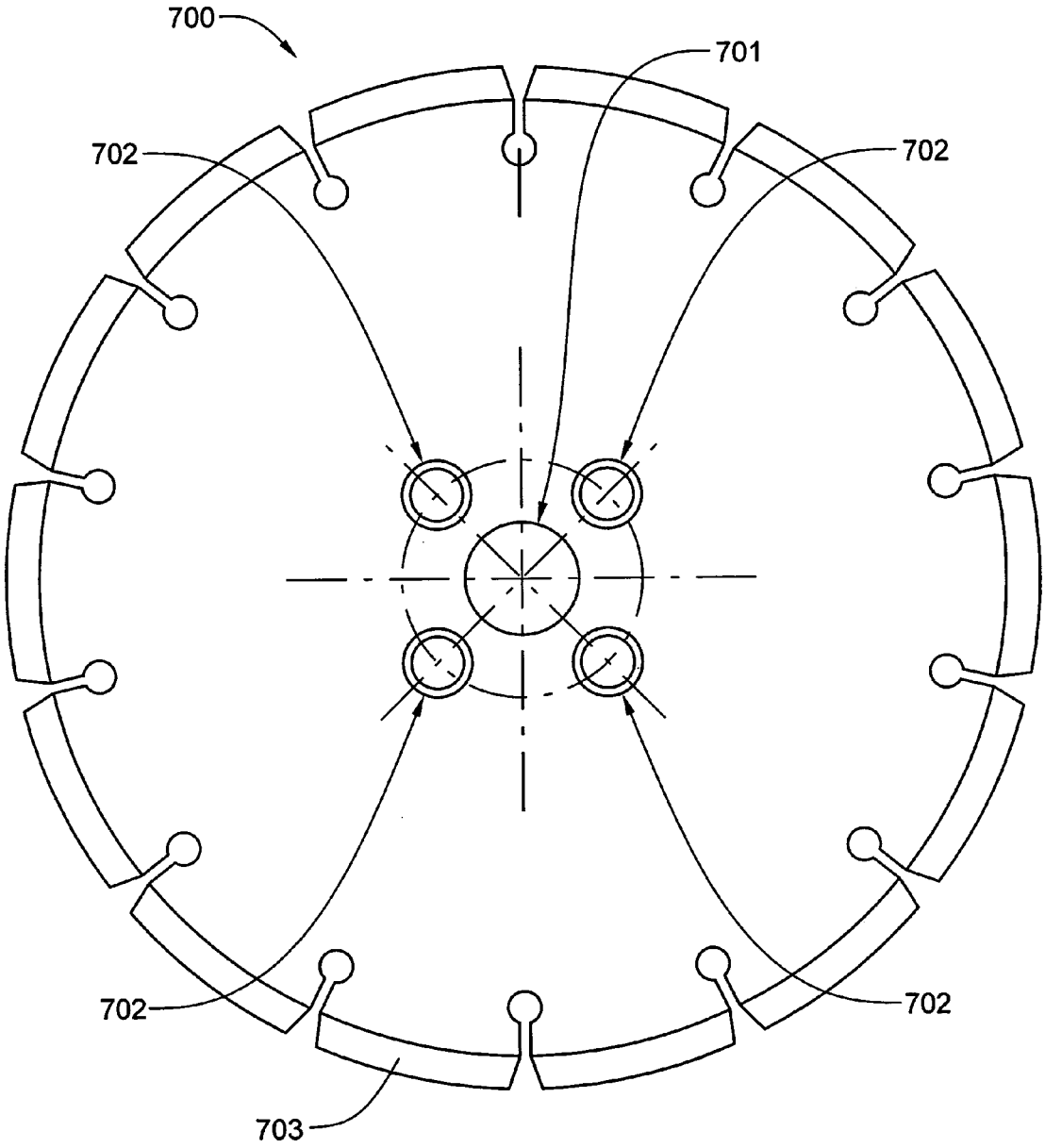
Figure 8:
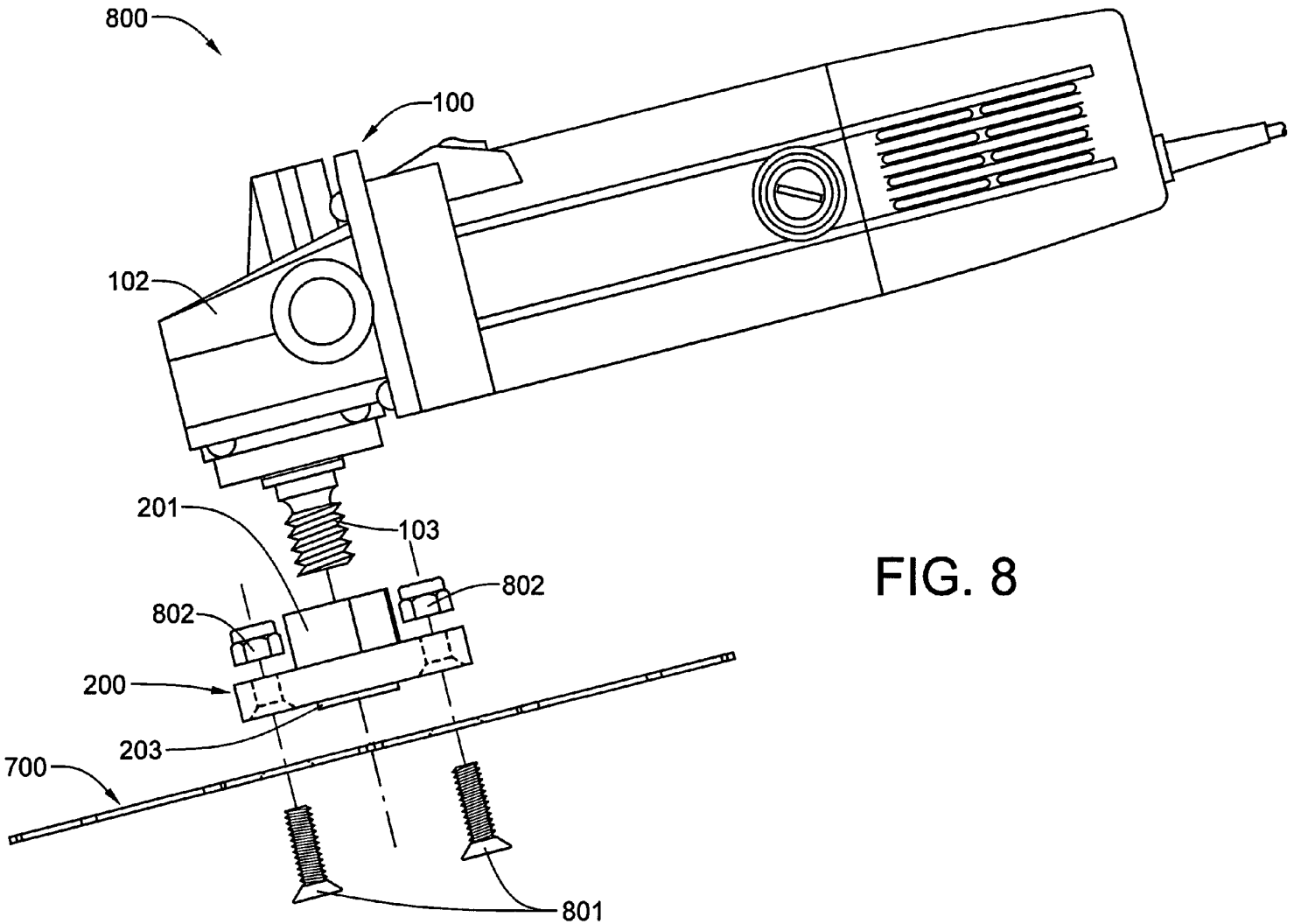
Figure 9:
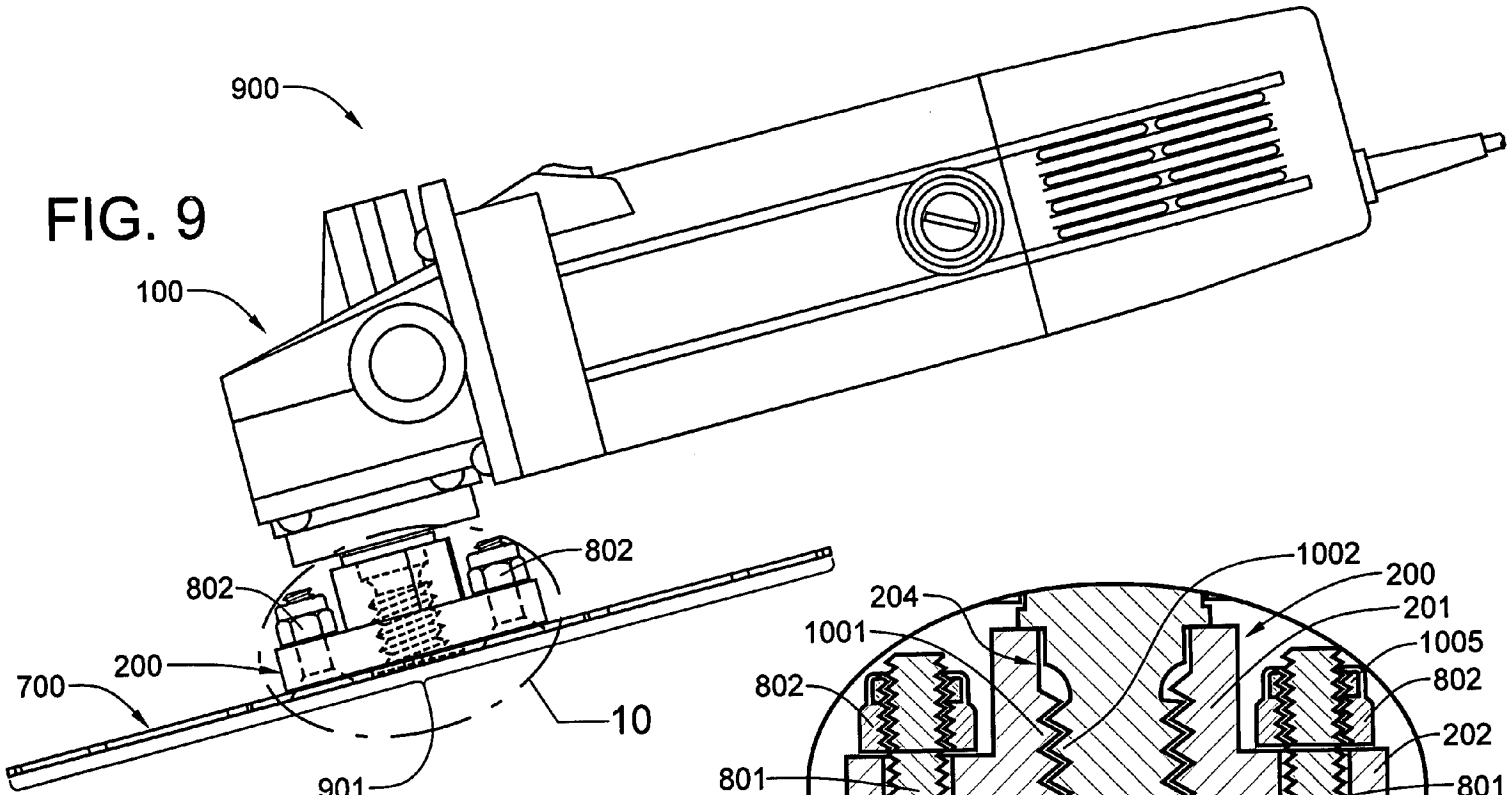
Figure 10:
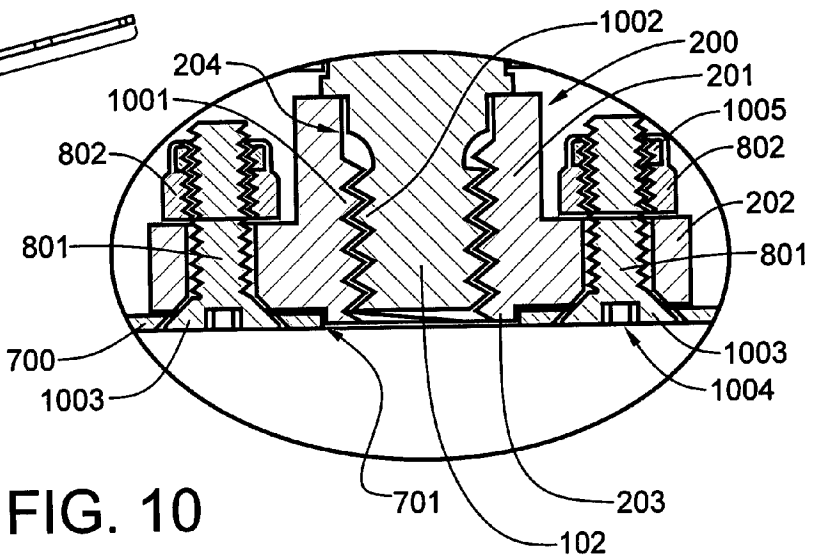
Figure 11:
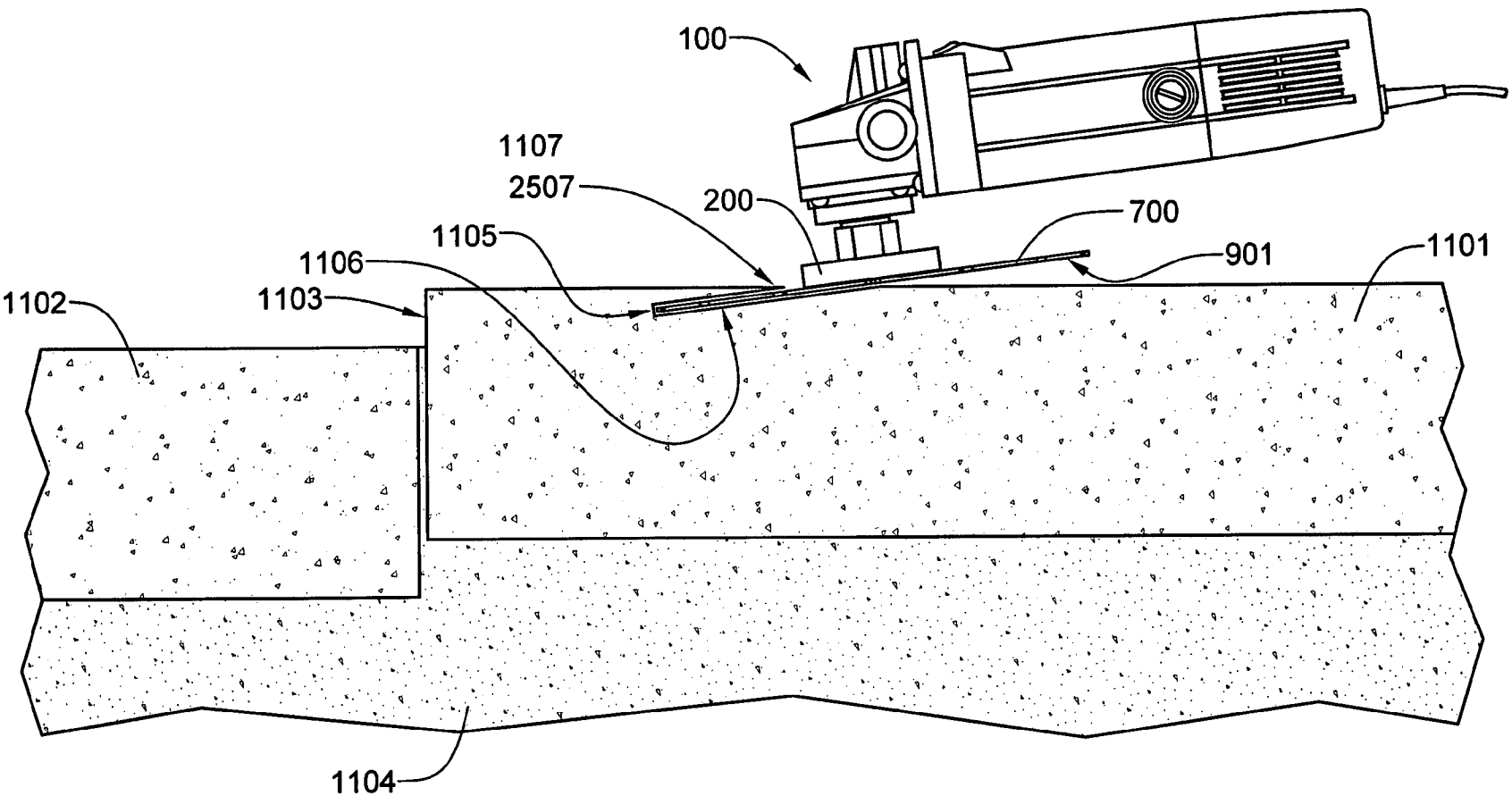
FIG. 11 is a side elevational view of the mounted blade making a first chamfer cut on the edge of a raised concrete slab.
Figure 12:
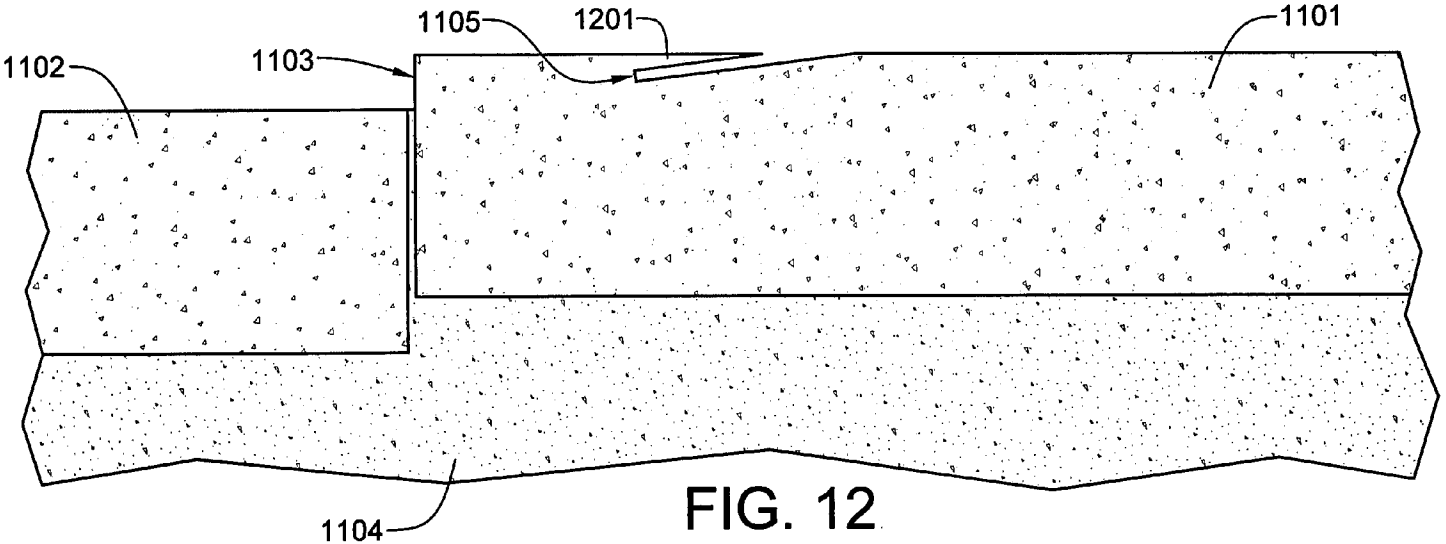
FIG. 12 is a side elevational view of the concrete slab, with the cutting equipment removed following the first cutting pass.
Figure 13:
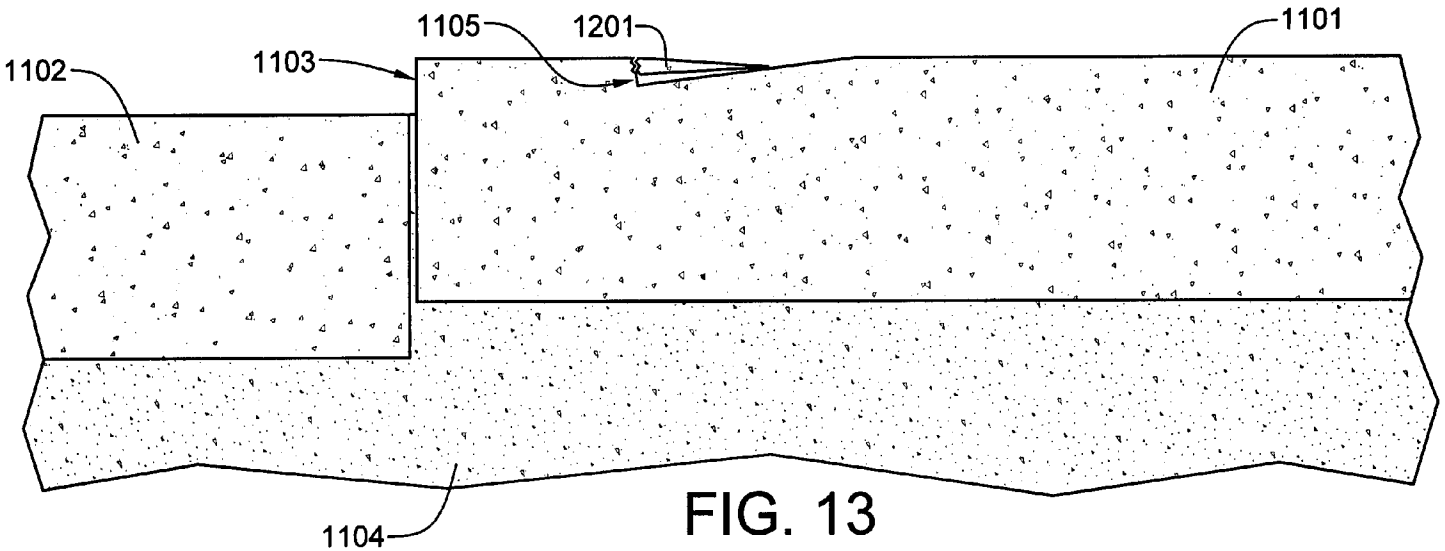
FIG. 13 is a side elevational view of the cut concrete slab of FIG. 12, following the fracturing of the first overhanging ledge.
Figure 14:
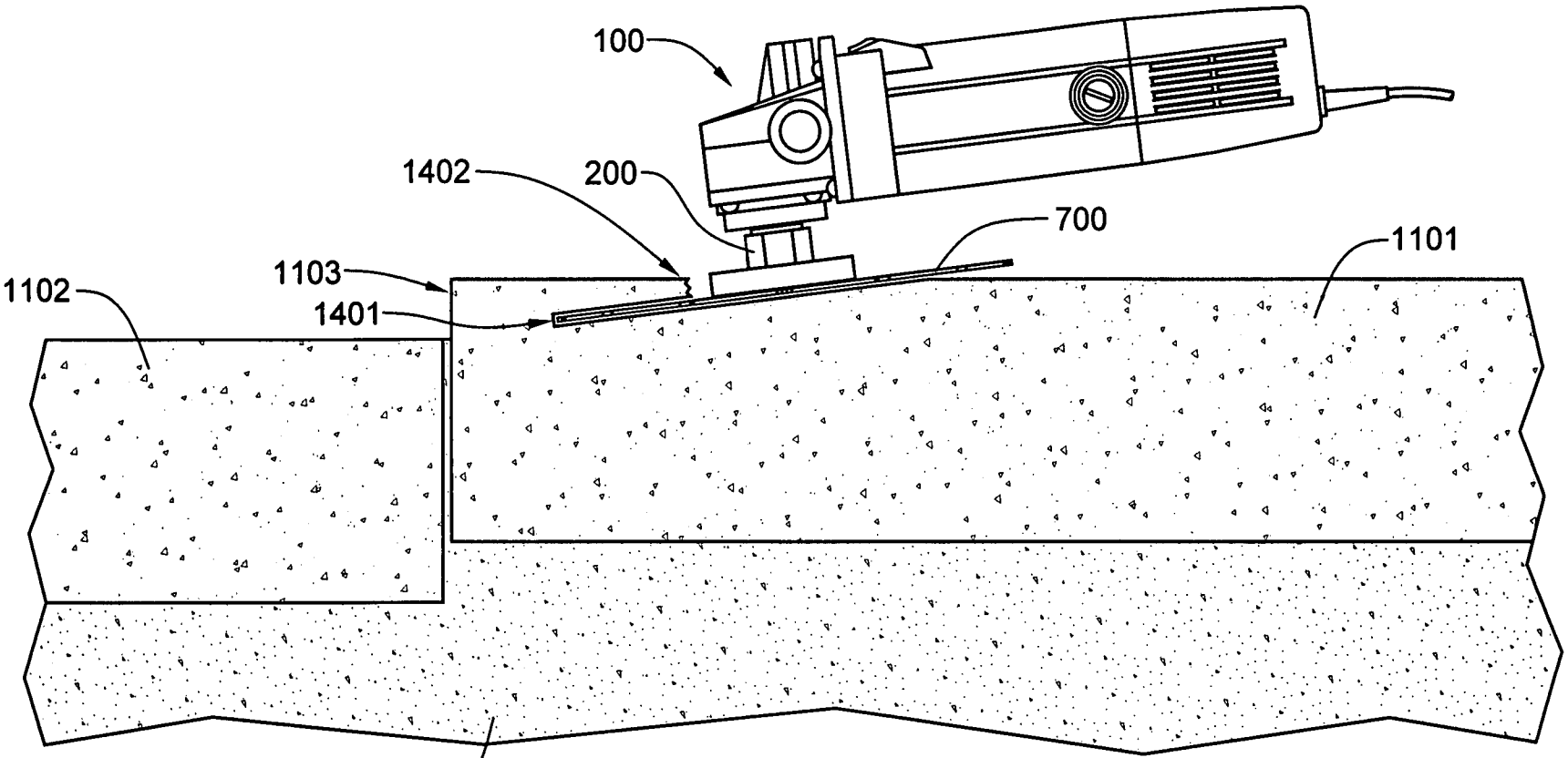
FIG. 14 is a side elevational view of the mounted blade making a second chamfer cut on the edge of the raised concrete slab shown in FIG. 11.
Figure 15:
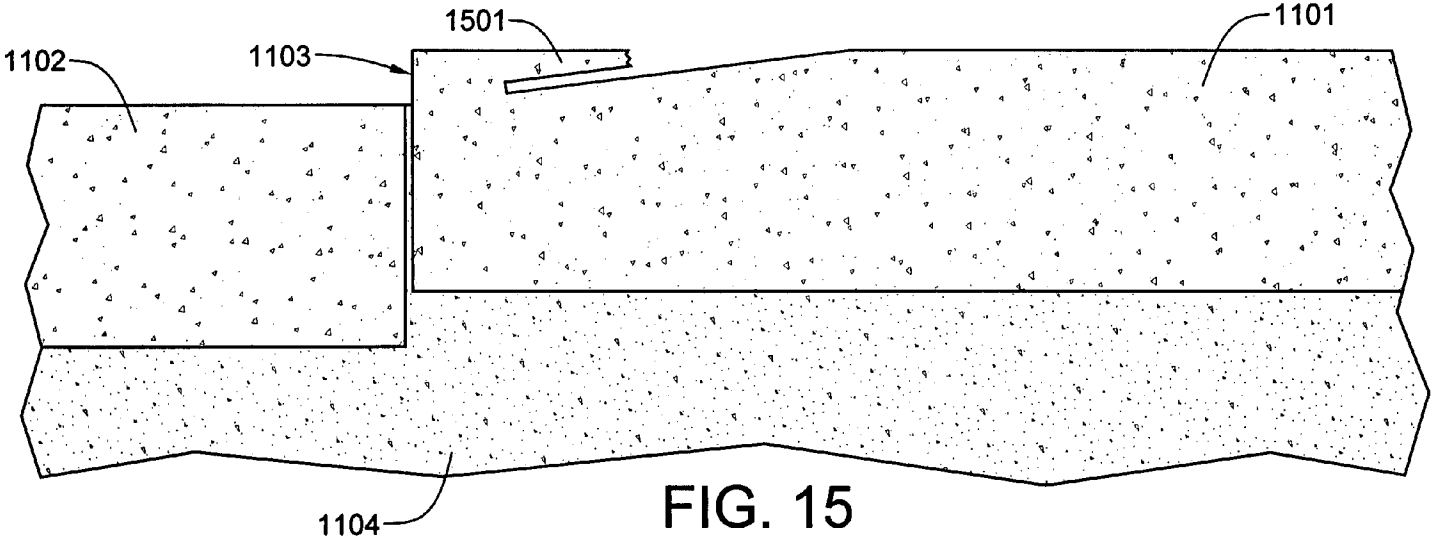
FIGS. 15 to 18 show various steps in the trip hazard removal process; and drawing
Figure 16:
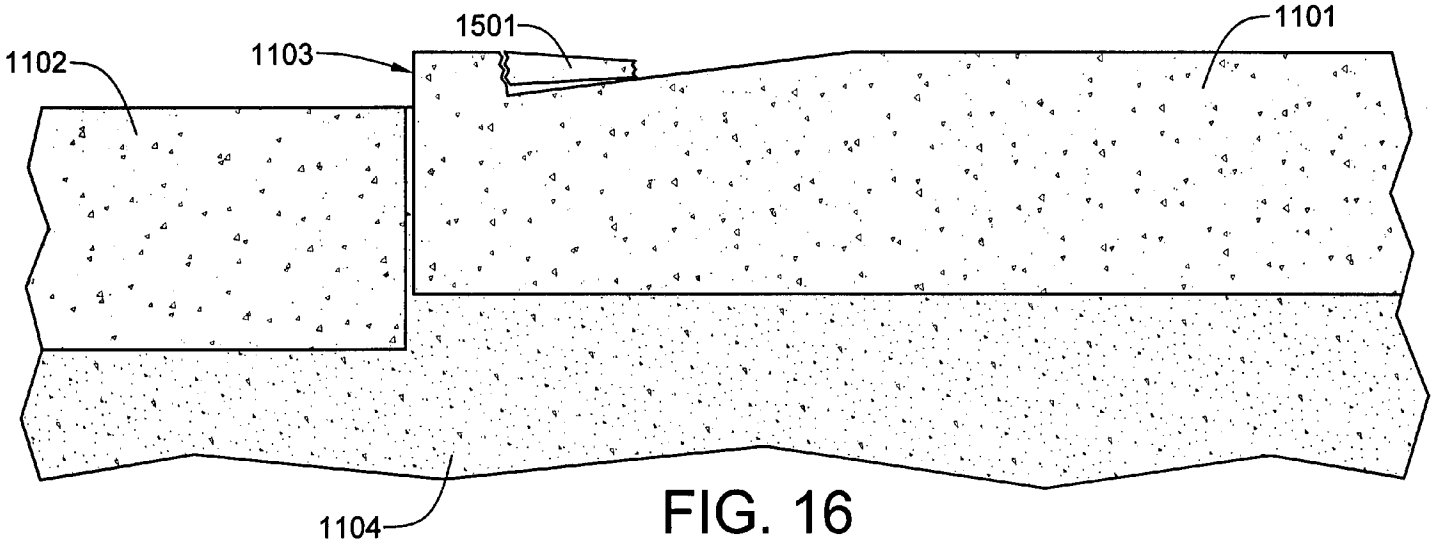
Figure 17:
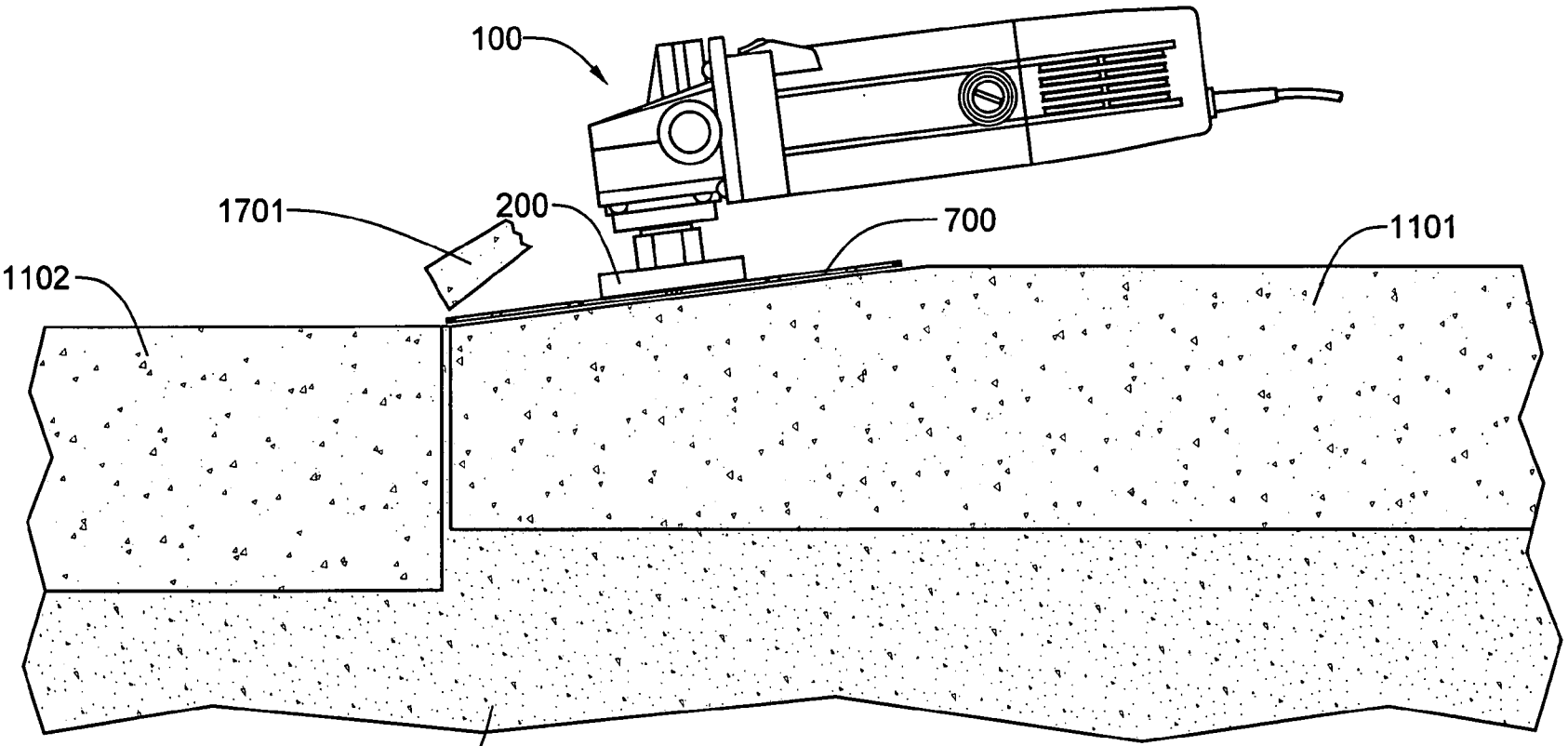
Figure 18:
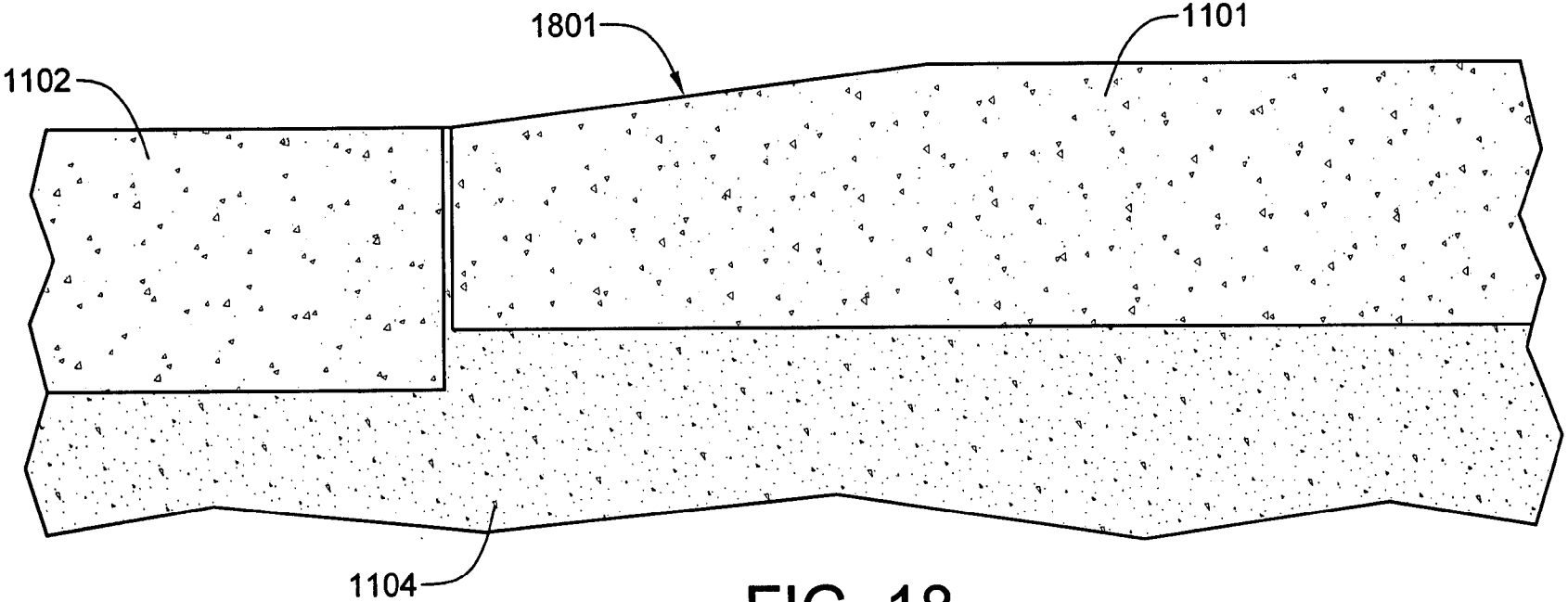
Figure 19:
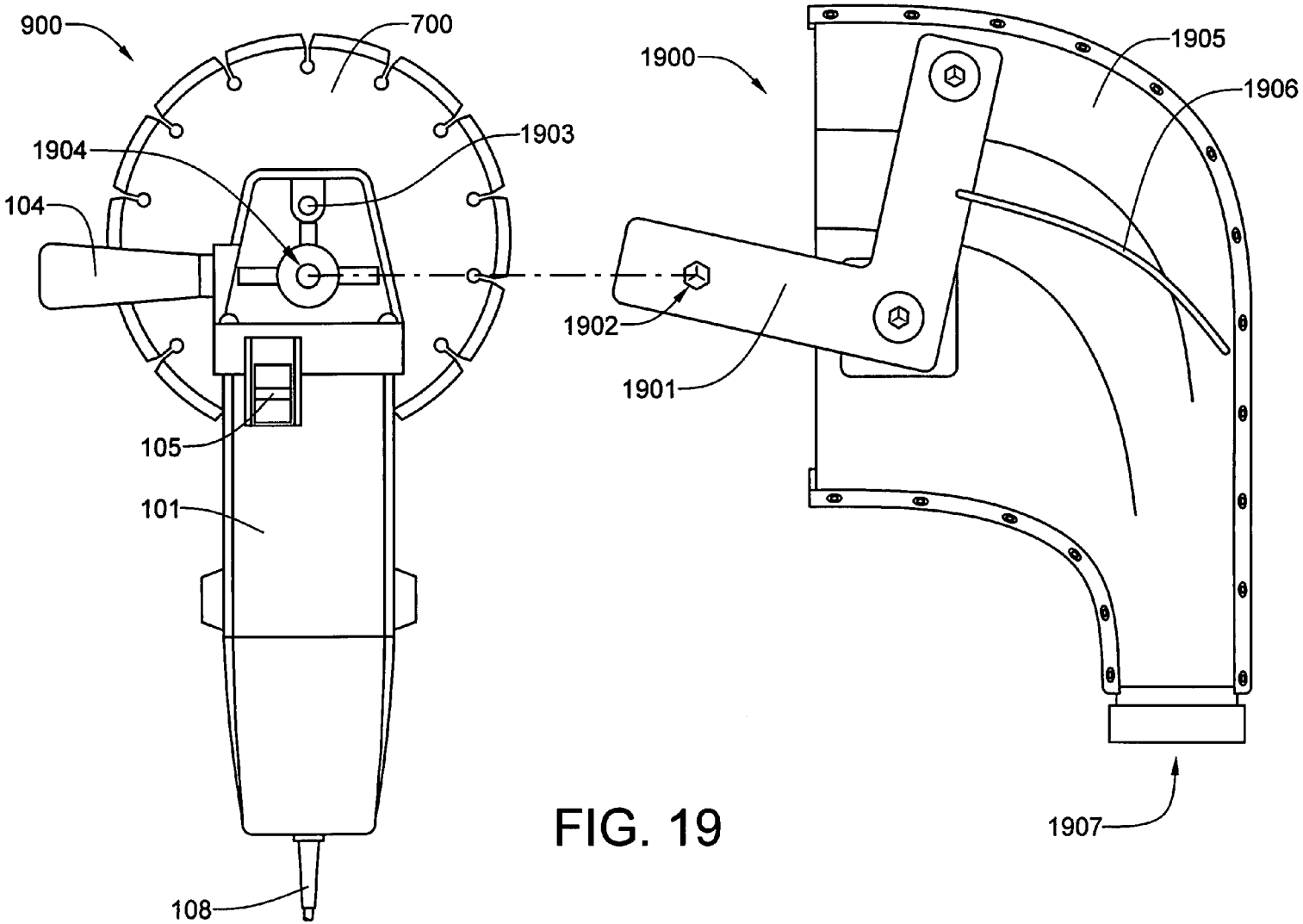

Referring now to FIG. 19, the flush-cutting concrete saw 900 of FIG. 9 is shown adjacent a dust abatement vacuum hood 1901. The edge 703 of blade 700 is formed from a metal matrix which incorporates diamond grit throughout, thereby enabling it, when spinning within a range of about 7 to 10 thousand revolutions per minute, to cut fully-cured concrete with ease. The vacuum hood 1901 has a metal, L-shaped, spring-mounted attachment bracket 1902 that can be bolted directly to the concrete saw 900. An attachment bolt 1903 threadably engages a threaded hole 1904 located on the concrete saw 900 in order to secure the vacuum hood 1901 to the concrete saw 900. The vacuum hood 1901 includes a rigid shell 1905 that is preferably either vacuum formed or injection molded from a tough polymeric material a polymer material such as acrylonitrile butadiene styrene (ABS) copolymer, polycarbonate, polystyrene, polyvinyl chloride (PVC), polyethylene, polyester, epoxy, or a multi-polymer alloy. For added strength and rigidity, the polymer material may incorporate structural fibers such as glass, graphite or Kevlar®. As an alternative to injection molding and vacuum forming, an open-mold layup process may be used-particularly when epoxy and polyester resins are used in combination with fiber structural fibers. Fiberglass car body components have been produced in this manner for more than half a century. As an alternative to the use of polymeric materials, the vacuum hood may be stamped or cast from a durable metal. Sheet metal stampings may be made, for example, from stainless steel, mild steel, chrome-molybdenum and chrome-manganese steel alloys, aluminum, and titanium. Castings may be made, for example, from metals such as aluminum, magnesium and titanium. Manufacture of the vacuum hood 1901 using vacuum-heat forming or injection-molding is preferred because the articles may be produced at low cost, while still being tough and light weight. A stabilizer rod 1906 interconnects the attachment bracket 1902 and the rigid shell 1905. The vacuum hood 1901 is equipped with a vacuum port 1907. A vacuum hose (not shown in this drawing) can be used to interconnect the vacuum port 1907 to a vacuum cleaner system (also not shown in this drawing).

Figure 20:
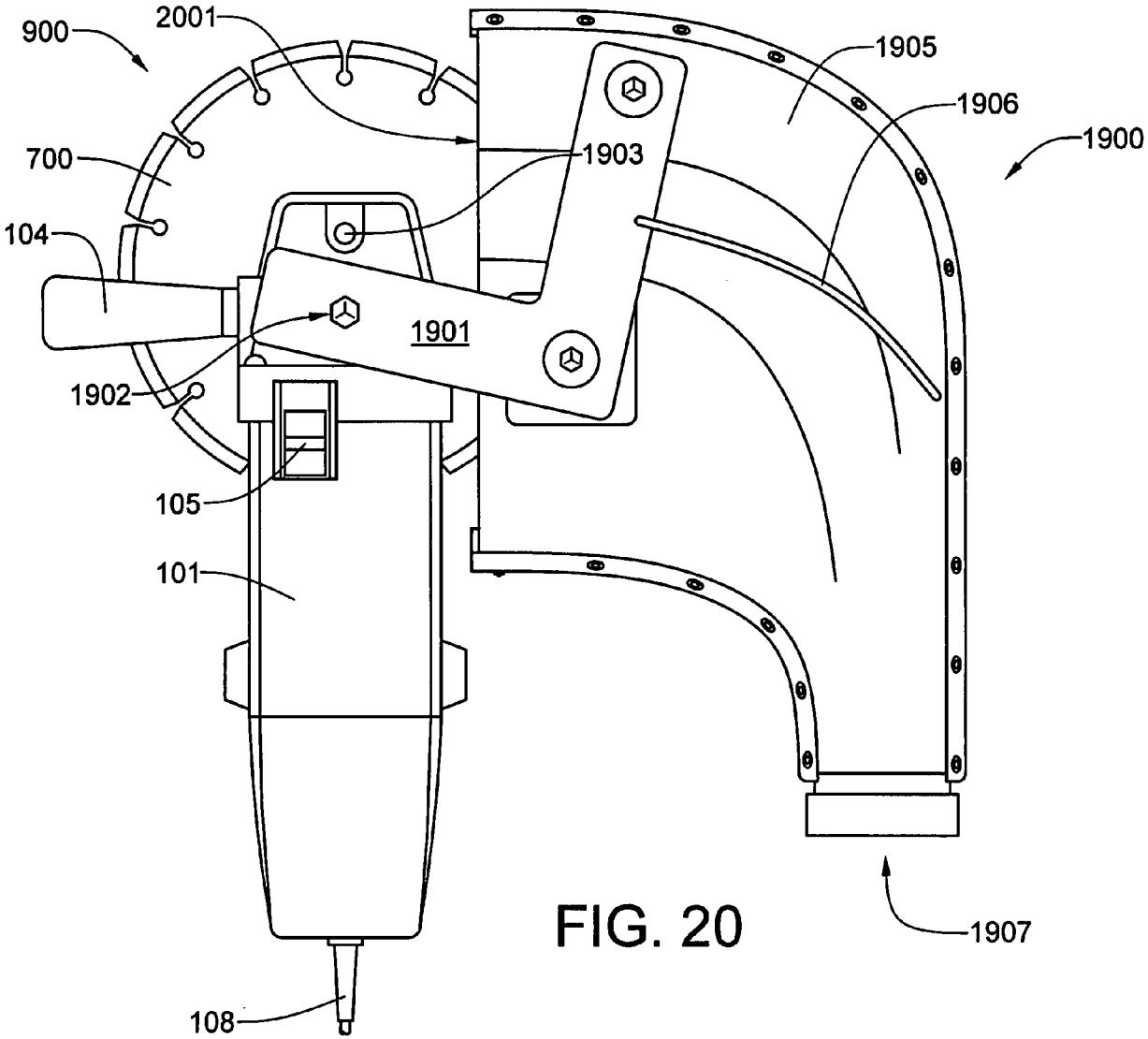

Referring now to FIG. 20, the spring-mounted attachment bracket 1902 of the vacuum hood 1901 has been bolted directly to the flush-cutting concrete saw 900 with attachment bolt 1903. As the blade 700 rotates clockwise (viewed from the top of the saw), pulverized concrete is discharged primarily to the right, into the chamber opening 2001 on the left side of the vacuum hood 1901. Thus, the vacuum hood 1901 is positioned to the side of the concrete saw 900 indicated by the instantaneous vector of a point P on the outer edge of the blade 700, when spinning and most distant from the grinder motor body 101. Internally, the vacuum hood 1901 is shaped so that the pulverized concrete is directed toward the vacuum port 1907, which maintains a lower-than-ambient pressure condition within the vacuum hood 1901. The shape of the vacuum hood 1901 and the low-pressure condition within ensures that more than about 95 percent of all concrete dust generated from concrete cutting operations is removed from the atmosphere and deposited in a vacuum system canister (shown in a later drawing).

Figure 21:
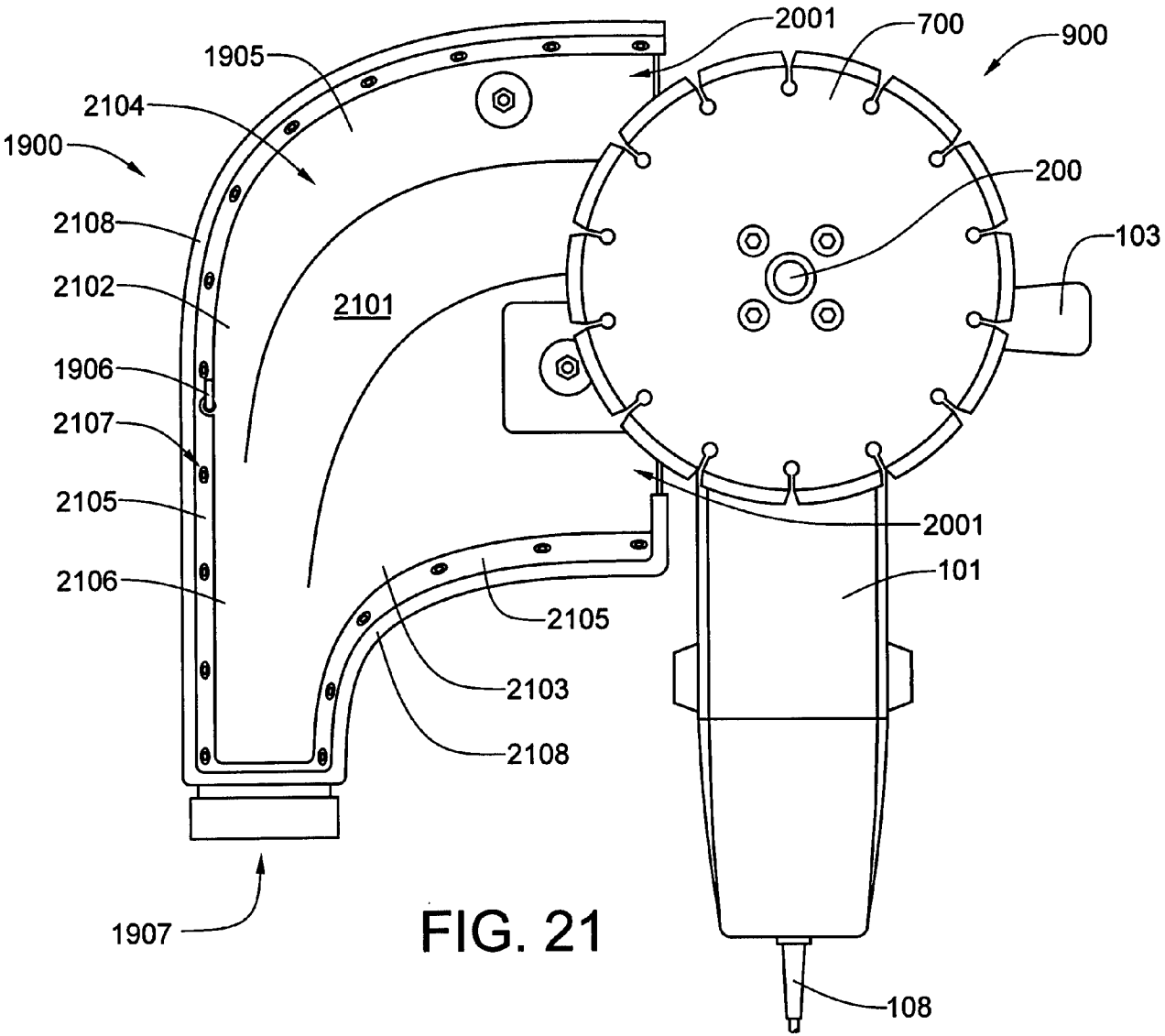

Referring now to the bottom view of FIG. 21, certain significant additional details of the new vacuum hood 1901 are now visible. The rigid shell 1904 has a ceiling portion 2101 and curved wall portions 2102 and 2103 which are unitary and form a chamber 2104. The bottom edges (not visible in this drawing figure) of the rigid shell 1904 are wrapped with a resilient polymeric foam layer (also not shown in this drawing figure). The foam layer is then covered with a flexible, preferably rubber, rectangular strip 2105 that is bent so that it assumes a U-shaped cross section. One upright portion of the "U" is bonded to the inside surface 2106 of the rigid shell 1904, while the opposite upright portion is bonded to the outside surface 2107 thereof. In this particular case, pop rivets 2108 passing through apertures in the rigid shell 1904, secure both upright portions of the "U" to the rigid shell 1904. The padded edges 2109 so formed generally lie in a common plane, so that when the vacuum hood 1901 is placed on a planar surface, such as a concrete slab, with the padded edges 2109 in contact therewith, the chamber 2004 is sealed along the padded edges 2109, having both an opening 2001 for the entry of pulverized concrete and a vacuum port 1907 through which the pulverized concrete is withdrawn from the chamber 2001. The chamber wall portions 2102 and 2103 are shaped so that incoming pulverized concrete is focused toward the vacuum port 1907.

Figure 22:
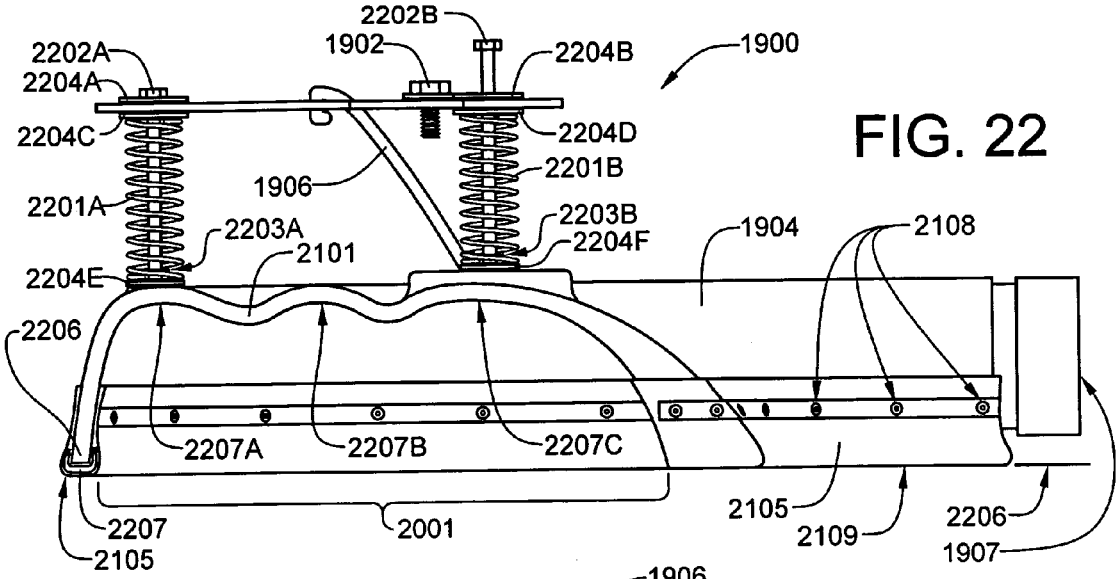

Referring now to FIG. 22, the vacuum hood 1901 is shown alone from the left-hand side. It will be noted that L-shaped attachment bracket 1902 is resiliently mounted to the rigid shell 1904 via a pair of steel coil springs 2201A and 2201B, each of which is secured to the rigid shell 1904 by an axial bolt 2202A and 2202B, respectively and four hex nuts 2203A–2204D (two for each axial bolt), the latter two of which are not seen in this view. Four flat fender washers (2204 generally) are used in combination with each bolt 2202A and 2202B, six of which (2204A–2204F) are visible in this view. The threaded shank 2205 of attachment bolt 1903 is visible in this view. In this view, one of the bottom edges 2206 of the rigid shell 1904 is visible, as is the resilient polymeric foam layer 2207 used to wrap the bottom edge 2206. The rectangular strip 2105 that has been folded around the resilient polymeric foam layer 2207 so that it assumes a U-shaped cross section is also visible in this view. The pop rivets 2108 which hold the folded rectangular strip 2105 to the rigid shell 1904 are also visible. It is also evident in this view that the padded edges 2109 lie in a common plane 2206. The vacuum port 1907 at the rear of the rigid shell 1904 is visible at the extreme right. It will be further noted that the ceiling portion 2101 of the rigid shell 1904 is molded so that it includes a pair of channels 2207A and 2207B, which assist in directing airflow within the chamber 2104 to the vacuum port 1907.

Figure 23:
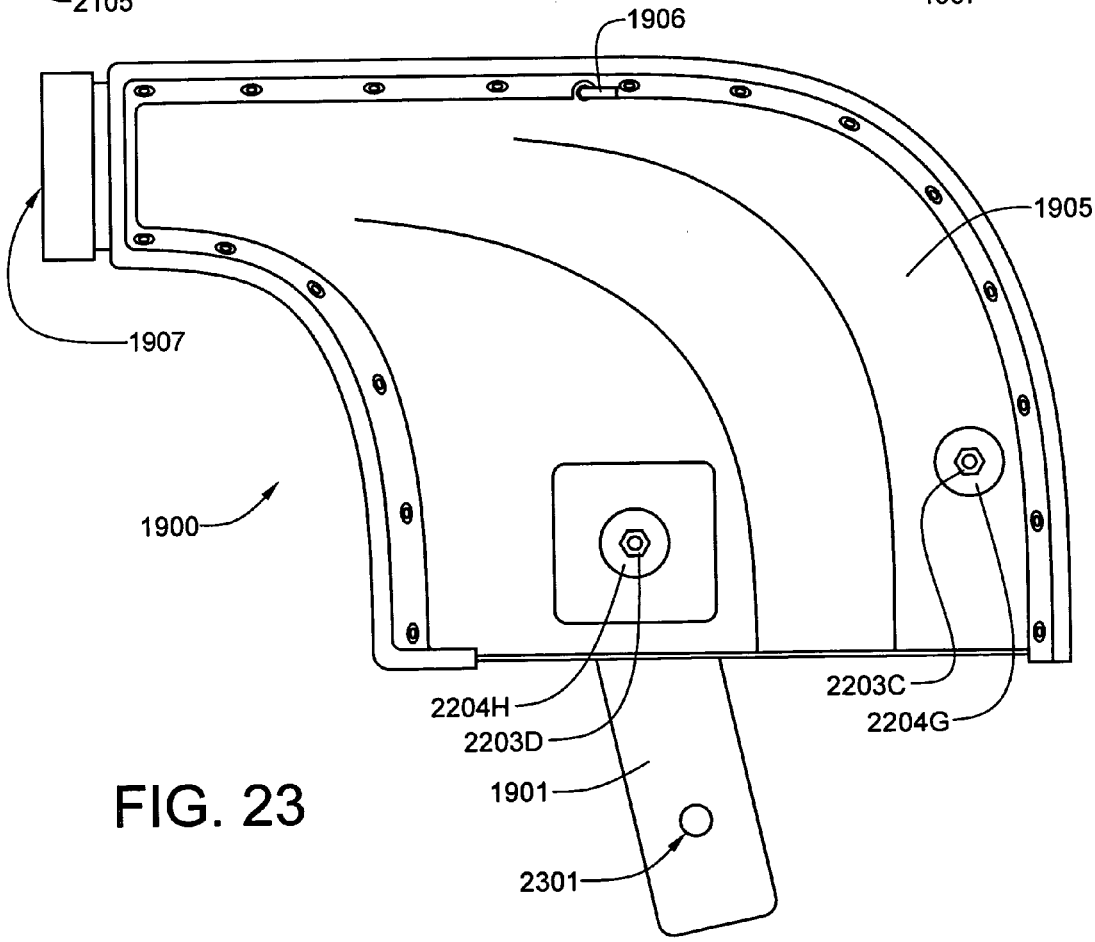

Referring now to FIG. 23, the seventh and eighth flat fender washers 2204G and 2204H are seen secured to the ceiling portion 2101 of the rigid shell 1904 by the two hex nuts 2203C and 2203D which were not visible in FIG. 22.

Figure 24:
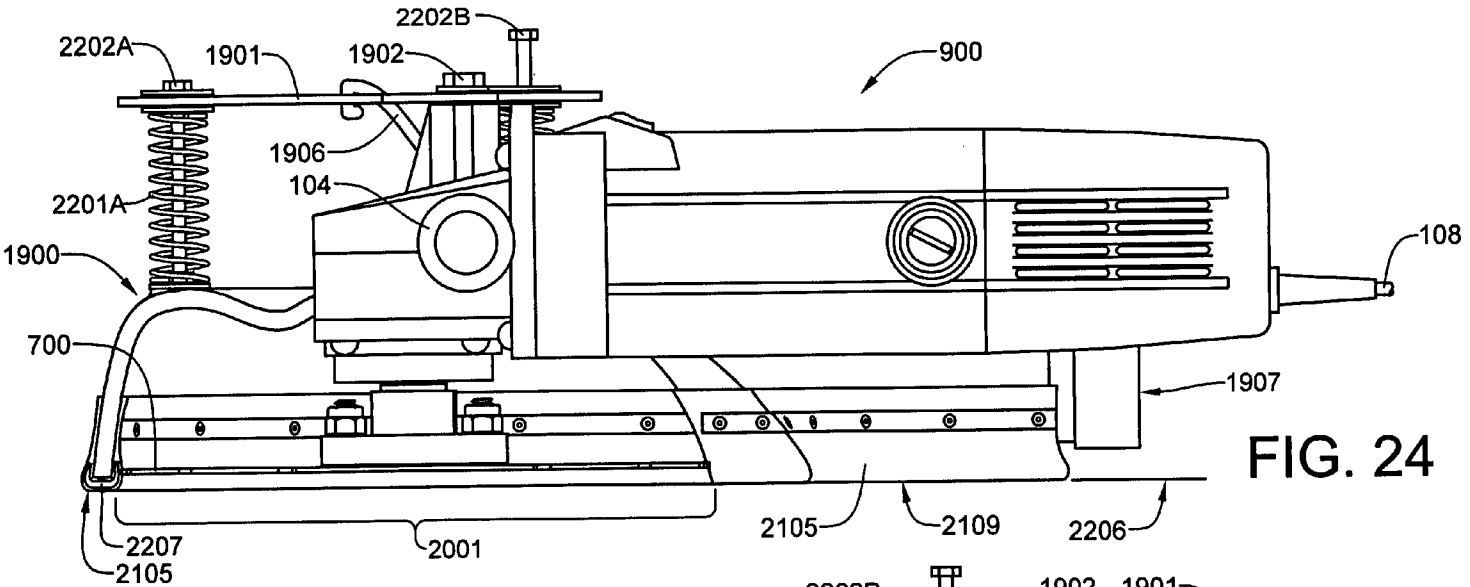

Referring now to FIG. 24, the vacuum hood 1901 can be seen behind the concrete saw 900. It can be seen in this view that the diameter of the blade 700 is about the same as the width of the chamber opening 2001. When the concrete saw 900 and attached vacuum hood 1901 are suspended in the air, the padded edges 2109 are positioned below the level of the blade 700. However, when the concrete saw 900 is making a cut in concrete slab, the padded edges 2109 are held against the slab by tension applied by the coil springs 2201A and 2201B.

Figure 25:
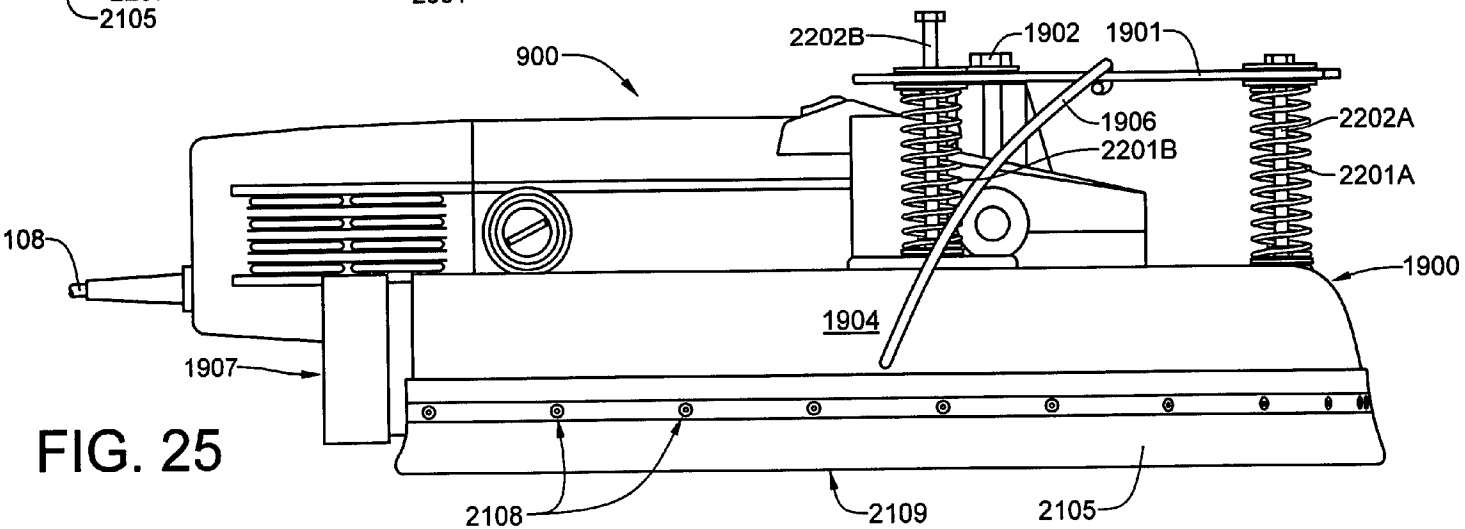

Referring now to FIG. 25, details of the right side of the vacuum hood 1901 are clearly visible. Each of the coil springs 2201A and 2201B is fully visible in this view, as is the portion of the padded edge 2109 on the right side thereof.

Figure 26:
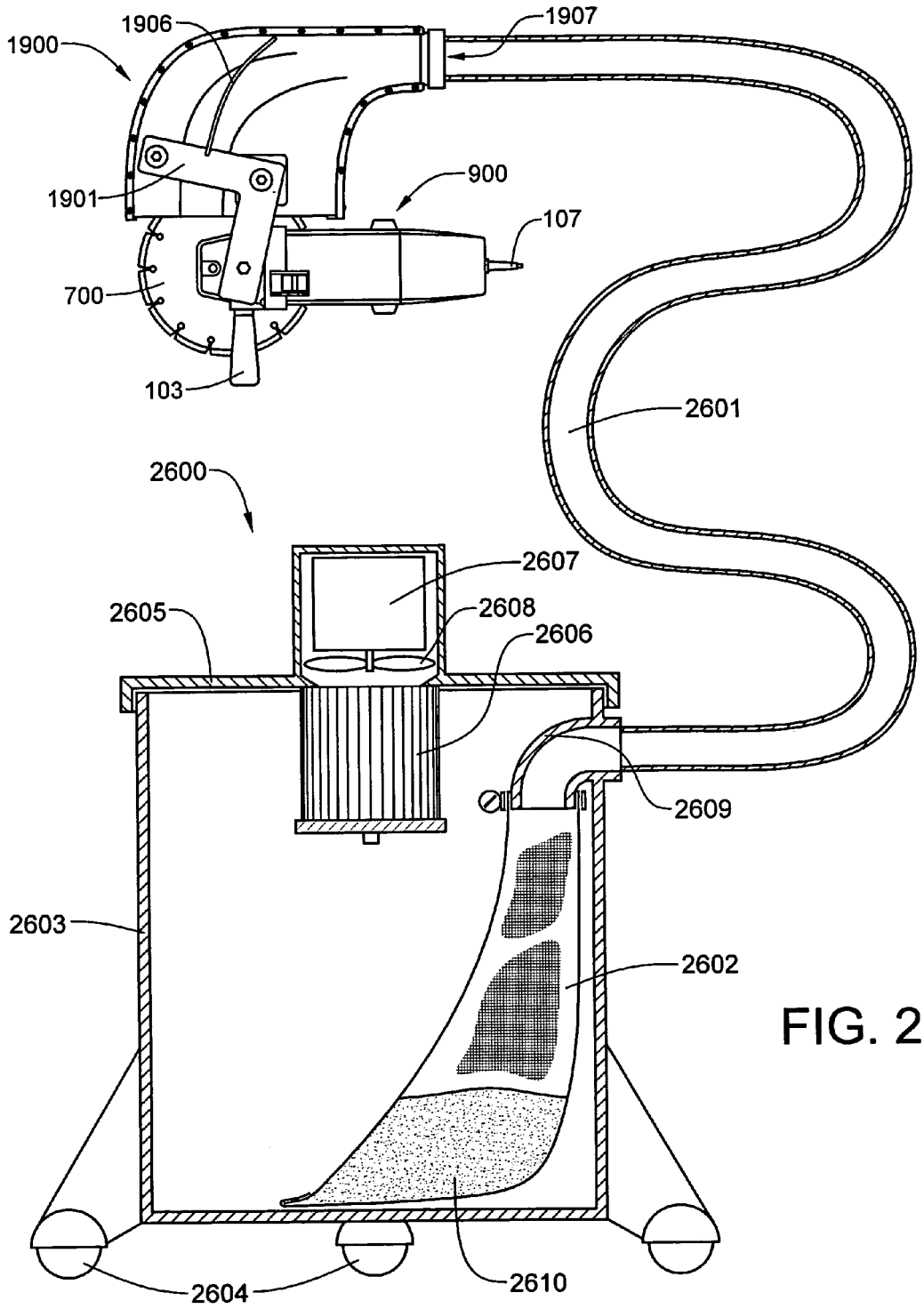

Referring now to FIG. 26, a complete flush-cutting concrete saw 900 in combination with an attached dust abatement device 1900, and a conventional wet/dry vacuum cleaner 2600 are shown interconnected by a vacuum hose 2601 as a complete concrete cutting and dust abatement system. The vacuum cleaner 2600, which is shown in a diagrammatic cut-away view, employs a reuseable, washable filter bag 2602. Shown in a cut-away view, the vacuum cleaner 2600 has a generally cylindrical debris collection tank 2603, to which are attached a plurality of casters 2604 which facilitate movement of the machine. The vacuum cleaner 2600 has a top cover assembly 2605 which seals a circular opening at the top of the tank 2603. The top cover assembly 2605 incorporates a replaceable filter 2606, an electric motor 2607 and a fan 2608 which is driven by the motor 2607. The fan 2608, when spinning at high speed, creates air pressure within the tank that is lower than ambient atmospheric pressure. As a result of this lowered pressure within the tank 2603, debris may be suctioned from outside the tank 2603 through an inlet pipe 2609 into the tank 2603. Without the filter bag 2602 installed on the inlet pipe 2609, debris would ordinarily collect within the tank 2603, itself, and rapidly clog the filter 2606. However, with the filter bag 2602 in place, as shown, the debris is collected within the bag 2602. The cloth, from which the bag 2602 is fabricated is tightly woven so that it traps debris particles 2610, yet sufficiently porous and having sufficient surface area to permit the passage of air without significant restriction.

Although only a single embodiment of the handheld flush-cutting concrete saw 700 and an associated dust abatement vacuum hood vacuum hood 1901 is shown and described herein, it will be obvious to those having ordinary skill in the art that changes and modifications may be made thereto without departing from the scope and the spirit of the invention as hereinafter claimed.

What is claimed is:

1. In combination with a hand-held grinder motor having a right-angle gear drive assembly with a downwardly facing output shaft, said grinder motor modified to cut concrete by installing a hub with a flush-mounted diamond grit edged blade on said output shaft, a dust abatement vacuum hood comprising:

a generally rigid shell positioned to one side of the grinder motor, said rigid shell, when placed upright on a generally planar surface, forming a chamber open on a side facing the blade, and having a port therein connectable to a vacuum cleaner system; and a mounting bracket that is both resiliently affixed to said rigid shell, and rigidly attachable to said grinder motor.

2. The combination of claim 1, wherein said mounting bracket is resiliently affixed to said rigid shell with at least one spring.

3. The combination of claim 2, wherein said mounting bracket is resiliently affixed to said rigid shell with a pair of steel coil springs.

4. The combination of claim 3, wherein each of said coil springs is attached to both said mounting bracket and said rigid shell with a single bolt and a pair of threaded nuts.

5. The combination of claim 1, wherein said rigid shell is placed on a side of the grinder motor pointed to by the instantaneous vector of a point P on the outer edge of the blade, when said blade is spinning and the point P is most distant from the grinder motor body.

6. The combination of claim 1, wherein except along the open side facing the blade, said rigid shell has downward facing edges that lie in a common plane.

7. The combination of claim 6, wherein said downward facing edges are wrapped with resilient material to provide effective sealing of the chamber when the rigid shell is positioned upright on a generally planar surface.

8. The combination of claim 7, wherein said resilient material is resilient polymeric foam covered by rubber sheeting.

9. The combination of claim 1, wherein said rigid shell is manufactured from a tough and durable polymeric material.

10. The combination of claim 9, wherein said tough and durable polymeric material is selected from the group consisting of acrylonitrile butadiene styrene copolymer, polycarbonate, polystyrene, polyvinyl chloride, polyethylene, polyester, epoxy, and multi-polymer alloys thereof.

11. The combination of claim 10, wherein said tough and durable polymeric material incorporates structural fibers selected from the group consisting of glass, graphite and Kevlar®.

12. The combination of claim 9, wherein said rigid shell is manufactured using a process selected from the group consisting of injection molding, vacuum-heat forming and open-mold layup.

13. A dust abatement vacuum hood for use with a hand-held right-angle grinder motor having a generally vertical output shaft, said grinder motor having a hub with a flush-mounted diamond grit edged blade mounted on said output shaft, said dust abatement vacuum hood comprising:

a generally rigid shell positioned to one side of the grinder motor, said rigid shell forming a downward facing cavity that also has an opening on a side facing the blade, said rigid shell also having a port therein connectable to a vacuum cleaner system, said port being spaced away from said opening; and a mounting bracket that is both resiliently affixed to said rigid shell, and rigidly attachable to said grinder motor.

14. The dust abatement vacuum hood of claim 13, wherein said mounting bracket is resiliently affixed to said rigid shell with at least one spring.

15. The dust abatement vacuum hood of claim 13, wherein said mounting bracket is resilient affixed to said rigid shell with a pair of steel coil springs, each of said coil springs being attached to both said mounting bracket and said rigid shell with a single bolt and a pair of threaded nuts.

16. The dust abatement vacuum hood of claim 13, wherein said rigid shell is placed on a side of the grinder motor pointed to by the instantaneous vector of a point P on the outer edge of the blade, when said blade is spinning and the point P is most distant from the grinder motor body.

17. The dust abatement vacuum hood of claim 13, wherein except along the open side facing the blade, said rigid shell has downward facing edges that lie in a common plane.

18. The dust abatement vacuum hood of claim 17, wherein said downward facing edges are wrapped with resilient material to provide effective sealing of said cavity when the rigid shell is positioned upright on a generally planar surface.

19. The dust abatement vacuum hood of claim 18, wherein said resilient material is resilient polymeric foam covered by rubber sheeting.

20. The dust abatement vacuum hood of claim 13, wherein said rigid shell is manufactured from a tough and durable polymeric material selected from the group consisting of acrylonitrile butadiene styrene copolymer, polycarbonate, polystyrene, polyvinyl chloride, polyethylene, polyester, epoxy, and multi-polymer alloys thereof.

21. The dust abatement vacuum hood of claim 20, wherein said rigid shell is manufactured using a process selected from the group consisting of injection molding vacuum-heat forming and open mold layup.

22. The dust abatement vacuum hood of claim 20, wherein said tough and durable polymeric material incorporates structural fibers selected from the group consisting of glass, graphite and Kevlar®.

23. In combination with a hand-held grinder motor having a right-angle gear drive assembly with a downwardly facing output shaft, said grinder motor modified to cut concrete by installing a hub with a flush-mounted diamond grit edged blade on said output shaft, a dust abatement vacuum hood comprising:

a generally rigid shell positioned to one side of the grinder motor, said rigid shell, when placed upright on a generally planar surface, forming a chamber open on a side facing the blade, and having a port therein connectable to a vacuum cleaner system; and means for resiliently coupling said rigid shell to said grinder motor.

24. The combination of claim 23, wherein said means for resiliently coupling comprises a mounting bracket, said mounting bracket being rigidly affixed to said grinder motor and resiliently coupled to said rigid shell.

25. The combination of claim 24, wherein said means for resiliently coupling further comprises at least one steel coil spring, said at least one coil spring providing resilient coupling of said bracket to said rigid shell.

26. The combination of claim 24, wherein said means for resiliently coupling further comprises a pair of coil springs, each coil spring being attached to both said mounting bracket and said rigid shell with a single bolt and a pair of threaded nuts.

27. The combination of claim 23, wherein said rigid shell is placed on a side of the grinder motor pointed to by the instantaneous vector of a point P on the outer edge of the blade, when said blade is spinning and the point P is most distant from the grinder motor body.

28. The combination of claim 23, wherein except along the open side facing the blade, said rigid shell has downward facing edges that lie in a common plane.

29. The combination of claim 28, wherein said downward facing edges are wrapped with resilient material to provide effective sealing of the chamber when the rigid shell is positioned upright on a generally planar surface.

30. The combination of claim 29, wherein said resilient material is resilient polymeric foam covered by rubber sheeting.

31. The combination of claim 23, wherein said rigid shell is manufactured from a tough and durable polymeric material.

32. The combination of claim 31, wherein said tough and durable polymeric material is selected from the group consisting of acrylonitrile butadiene styrene copolymer, polycarbonate, polystyrene, polyvinyl chloride, polyethylene polyester, epoxy, and multi-polymer alloys thereof.

33. The combination of claim 32, wherein said tough and durable polymeric material incorporates structural fibers selected from the group consisting of glass, graphite and Kevlar®.

34. The combination of claim 31, wherein said rigid shell is manufactured using a process selected from the group consisting of injection molding, vacuum-heat forming and open-mold layup.

* * * * *